United States Patent [19]

Levier

[11] Patent Number: 4,901,803

[45] Date of Patent: Feb. 20, 1990

[54] METHOD AND EQUIPMENT FOR PERFORMING DRILLING OPERATIONS AND SERVICING IN AN UNDERWATER WELL FROM A FLOATING SURFACE INSTALLATION

[75] Inventor: Jean-Francois Levier, Croissy sur Seine, France

[73] Assignee: Institut Francais du Petrole, Rueil Malmaison, France

[21] Appl. No.: 211,875

[22] Filed: Jun. 27, 1988

[30] Foreign Application Priority Data

Jun. 26, 1987 [FR] France ..... 87 09034

[51] Int. Cl.[4] ..... E21B 7/12; E21B 19/09; E21B 43/013

[52] U.S. Cl. ..... 175/5; 166/340; 166/345; 166/358; 166/359; 166/364

[58] Field of Search ..... 175/5, 7, 8; 166/363, 166/364, 359, 367, 350, 338, 339, 340, 344, 345

[56] References Cited

U.S. PATENT DOCUMENTS

| | | | |
|---|---|---|---|
| 3,241,864 | 3/1966 | Shaffer | 166/364 X |
| 3,251,611 | 5/1966 | Haeber et al. | 166/363 X |
| 3,424,241 | 1/1969 | Triplett | 166/340 |
| 4,266,886 | 5/1981 | Milton | 166/367 X |
| 4,495,999 | 1/1985 | Sykora | 166/364 |
| 4,673,041 | 6/1987 | Turner et al. | 166/340 |
| 4,703,813 | 11/1987 | Sieler | 166/359 X |

*Primary Examiner*—Stephen J. Novosad
*Attorney, Agent, or Firm*—Antonelli, Terry & Wands

[57] ABSTRACT

Apparatus for performing drilling operations and for servicing an underwater well from a surface installation comprises a main string that is removable from the top of the wellhead in a way that is totally independent of auxiliary hoses which are hoses suspended from the surface installation independently of the main string and at a distance from it, from separate elements making possible the continuous advance of the hoses. The length of the hoses is adjusted in service so that they form, in the water, a plurality of catenaries supported by the surface installation and connected to the top of the wellhead with interposition of curvature-limiting elements.

4 Claims, 3 Drawing Sheets

Figure 1:
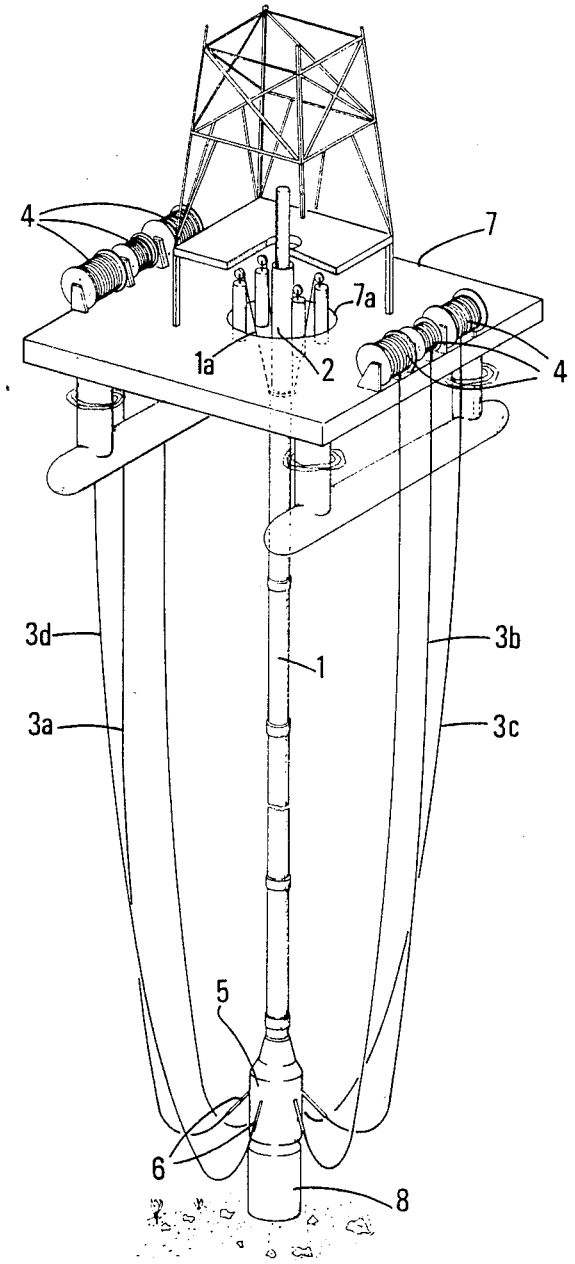

METHOD AND EQUIPMENT FOR PERFORMING DRILLING OPERATIONS AND SERVICING IN AN UNDERWATER WELL FROM A FLOATING SURFACE INSTALLATION

This invention relates to a method and a piece of equipment for performing drilling operations and servicing in an underwater well from a floating surface installation.

Techniques are already known for performing drilling operations and servicing in an underwater well from a surface installation using a piece of equipment for an underwater wellhead, a riser connecting the top of this piece of equipment to the surface installation, this riser comprising a main string and peripheral auxiliary hoses for servicing and remote control that connect said piece of equipment to said installation.

These techniques are, for example, illustrated by U.S. Pat. Nos. 3,424,241; 3,424,242; 3,532,162 and 4,281,716, French patent 1,363,487 and British patent 1,058,110.

These prior techniques exhibit a certain number of drawbacks.

In particular, rapid disconnection of the riser in stormy weather presents a breaking risk all the higher the greater the water depth. On the other hand, it requires equipping the riser with buoyancy elements having large dimensions to support the unit consisting of the main string and the satellite or peripheral auxiliary hoses that are fastened to this main string.

Moreover, the positioning of these risers is protracted and requires frequent interruptions allowing pressure tests of the peripheral hoses to be performed at each addition of a new riser element.

The invention eliminates the drawbacks indicated above by providing, in particular, a method for performing drilling operations and servicing in an underwater well from a surface installation, characterized particularly by he following successive steps:

(a) said piece of equipment is connected in a removable way to the lower end of a first section of the main string, supported from the surface installation and to said piece of equipment are connected laterally the lower ends of auxiliary hoses for servicing and remote control whose upper ends are held on said installation, at a distance from said main string, with interposition of curvature-limiting elements directed downward, in the vicinity of said piece of equipment, so that, under the action of gravity, each of said auxiliary hoses forms a catenary, at a distance from said main string, between said piece of equipment and the surface installation, (b) said piece of equipment is gradually lowered from the surface installation, being made up of successive sections of said central string and causing a sufficient length of said auxiliary hoses to advance from the surface installation until said piece of equipment is connected to the top of the wellhead, and (c) the length of said auxiliary hoses is adjusted from the surface installation, thus modifying the distance separating said catenaries from the bottom of the water.

Figure 2:
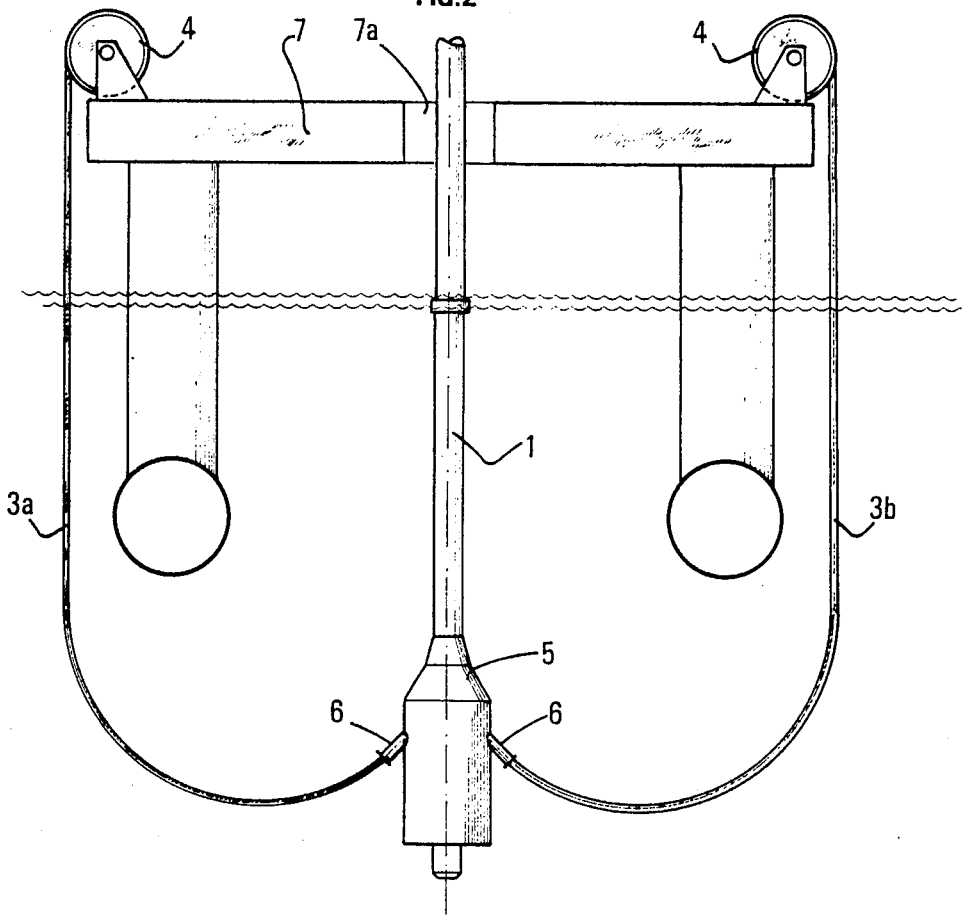
Figure 3:
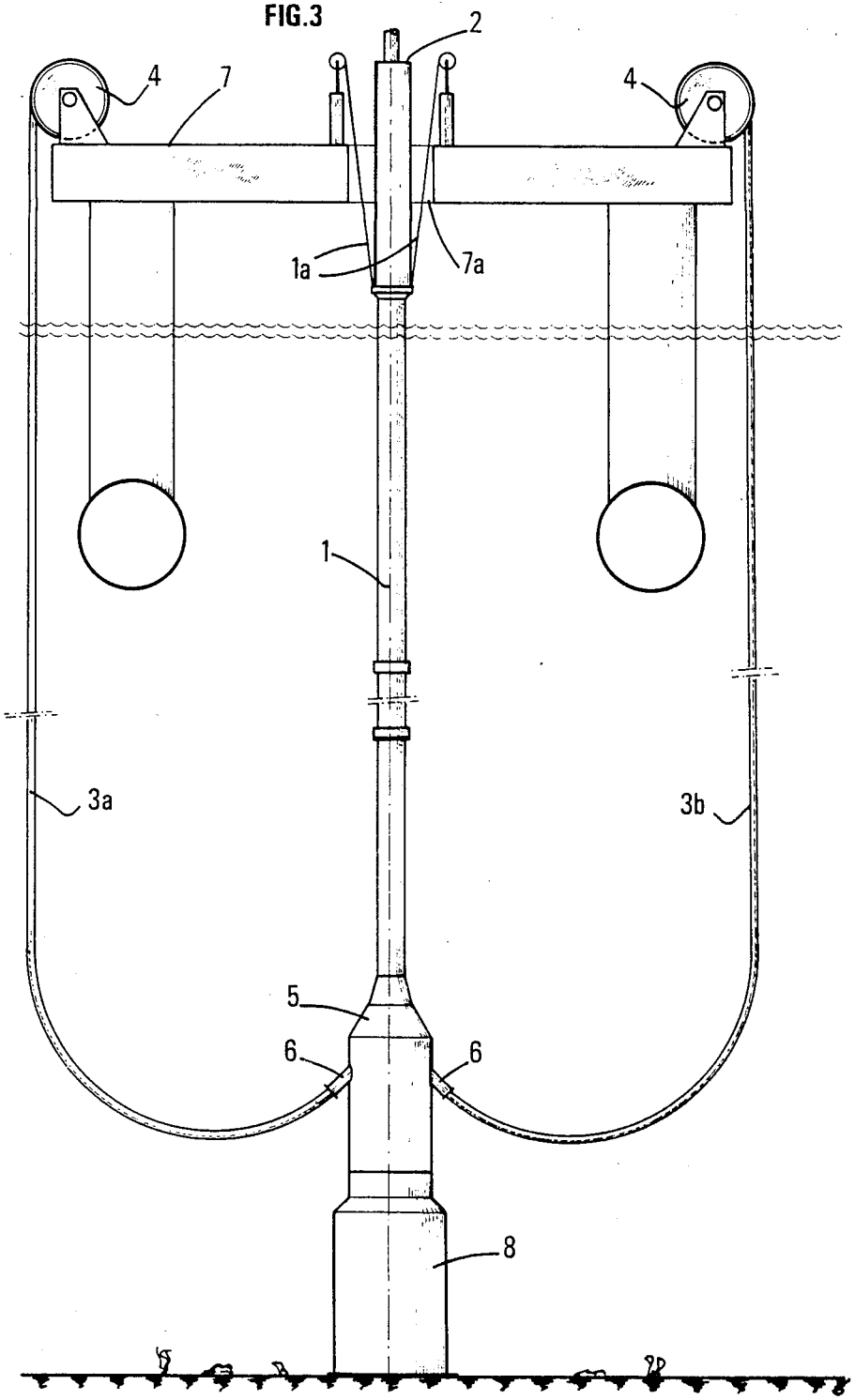

An embodiment of the invention is described below with reference to the accompanying figures of which:

FIG. 1 illustrates a type of equipment for putting the invention into practice, FIGS. 2 and 3 show different steps for positioning a piece of equipment according to the invention.

The piece of equipment illustrated by FIG. 1 comprises:

(1) A drilling riser (1) that is very simplified and lighter. In fact, it is reduced to a main tube (outside diameter measured in inches 21" or 18 ⅝" most often) composed of unit sections, called joints, with a length (measured in feet) varying between 50' and 80' depending on the onboard handling capabilities. This riser is assembled by connecting each joint vertically to the preceding one and so on.

Optionally, an electric wire can be progressively fastened to it for the multiplex control of underwater system (BOP or wellhead). As for the standard riser, an articulated joint at the foot of the riser is necessary to assure the flexibility required at this level. Optionally, an automatic opening for filling the riser can be used to prevent it being crushed by hydrostatic pressure, when the water depth requires it. For certain condition of use, it might be necessary also to use an articulated joint at the top of the riser.

(2) A simplified telescopic joint (2). An inside tube of the joint is connected to a device for diverting possible gas kicks (diverter) fastened to a floating support 7. The outside tube of the joint is connected to the top of the riser is suspended by tensioning cables 1*a*. The inside tube slides on the inside of the outside tube that is stationary in relation to the bottom of the sea.

(3) A certain number of hoses (3*a*, 3*b*, 3*c*, 3*d* . . . ), with a maximum of six for the drilling, to perform the following functions:

Two safety lines (choke line 3*a* and kill line 3*b*). The minimum inside diameter is 3" and the maximum service pressure is 1,050 bars (15,000 psi). An inner diameter of 4 inches (4" I.D.) is recommended for great depths.

A mud pumping line whose outside diameter is preferably equal to the outside diameter of the preceding lines to standardize the onboard handling equipment.

Two hydraulic lines 3*c*, 3*d* of 350 bars maximum service pressure.

An additional line, for example for the pumping of compressed air into enclosures obtaining a variable buoyancy.

(4) The handling system of all these hoses. There are several systems already used in operation. They should be made as a function of the installations and available spaces on the deck, operational conditions and cost. Such a system as hereinafter described uses motorized drums 4 placed on floating installation or support 7.

Each drum 4 for large-diameter hoses could have a capacity of 400 m (this corresponds to practical dimensions for the drum). A specific study for each drilling unit will have to be made to define the optimal combination for the maximum water depth where this unit operates: number of drums, dimensions, handling means, operational procedures. Thus, to drill in a shallow zone (300 m, for example), a single drum for each type of hose will be loaded on board. For 1000 m of water, it will be necessary to use three 400 m drums.

An example of operational sequence for a depth of 700 m is described below.

The first hoses (3*a*, 3*b*, 3*c*, 3*d* . . . ) are entirely unwound from the deck of the installation 7, at the same time as riser 1 is lowered until the arrival of the ends at retaining cradles at the edge of the deck. After fastening of these ends by quick clamps in the cradles, the retaining wires to the drums are detached from the ends. Empty drums 4 are lifted from the motorization couplings. Full second drums 4 are then positioned in these couplings. The additional lengths of 400 m are then connected to their preceding lengths hanging over the edge. A pressure test of the entire 800 m length is then performed. The fastening clamps in the retaining cradles are then opened and the lowering of riser 1 is resumed. When the necessary lengths have been unwound, the hoses (*3a, 3b, 3c, 3d* . . . ) are gripped by clamps on the deck. The motorizations and drums 4 are then locked.

The last drums are provided with axial rotating joints on which the hoses are connected to the inside of drums 4.

Different steps of the installation of the system described above are illustrated by FIGS. 2 and 3.

Blowout preventer BOP 5 is placed above central opening *7a* of installation 7. All hoses and electric wires are then connected to this BOP. Stiffeners 6 are placed after the connection ends to maintain a constant angle (which can be equal to 45°, but should be determined as a function of the particular specifications) well defined in relation to the vertical axis of the BOP. All hoses (*3a, 3b, 3c, 3d* . . . ) are then pressure tested.

They describe loops under the barges of semisubmersible unit 7.

At the same time as BOP 5 is lowered with riser 1, hoses *3a, 3b, 3c, 3d* are unwound to maintain a sufficient excess length to absorb the heave without variation of tension.

When BOP 5 is firmly connected to wellhead 8, appropriate lengths of each hose are unwound to obtain heave compensation without touching the sea bottom.

Withdrawal is performed by the reverse procedure. When BOP 5 is fastened at the level of its handling and storing platform on installation 7, each hose is unwound, while, however, remaining attached by a return movement line to facilitate the connecting during the next lowering of the riser.

The system according to the invention obtains numerous advantages in comparison with so-called integrated conventional risers.

The riser can be disconnected in bad weather, the driller, however, keeps his BOP entirely operational with all its control lines connected.

In case of accident, the floating drilling platform can be moved away and keep its connections with the BOP. Thus the great difficulties encountered (cf. Campeche in Mexico) to reconnect these connections are avoided.

The waterline volume requirements are reduced by about 40%.

The floats obtaining this waterline are simpler, all identical and therefore less expensive to purchase and install.

The telescopic joint has a much simplified support-ring. It is no longer necessary to have a system of automatic connections to connect the peripheral rigid lines to the hoses assuring the connections with the circuits on board.

The time saved by each riser maneuver is considerable, since the high pressure tests at each connection of a new riser joint are eliminated. In addition, the connections themselves are much faster, the fitting being performed directly without previous orientation. Thus, 10 to 12 hours can be saved for 1200 m of water, at each lowering.

The riser connectors are simplified and much lighter. The steel plates to guide the peripheral lines and withstand the great forces that they exert when they are pressurized (700 or 1000 bars) are eliminated.

All the guide clamps (4 to 5 per riser joint) along the riser joint are eliminated.

The bottom effects, due to the pressure in the peripheral lines, and the dangers of buckling while flowing are eliminated.

The inside diameter of the hose for removal of gases is constant all the way along, thus avoiding turbulences and erosion by grains of sand carried along at great speed that are in the rigid tubes integrated with the riser.

The thermal conductivity of the hoses is much lower than that of steel and therefore reduces the danger of formation of hydrates.

The weight of the riser on the deck is reduced nearly 50% or about 250 t fewer for a riser of 1000 m.

Maintenance of the riser is much simplified and, therefore, less expensive.

The elimination of the pressure tests at each connection eliminates necessary specialized tools.

The riser-floats unit being thinner, bears less drag and is less affected by environmental stresses.

The suspended weight, when the riser is not connected to the wellhead, is much reduced, greatly decreasing the dynamic strainings and, therefore, the danger of breaking.

Finally, a shorter natural period greatly diminishes the dynamic stresses, both longitudinal and crosswise.

The system according to the invention uses components which are all widely tested. Considerations of local availability of 3" or 4" steel seamless tubes and hoses can have a considerable savings effect and greatly influence the decision of the choice during the local construction of new drilling units.

What is claimed is:

1. A method for performing drilling operations and servicing of an underwater well from a surface installation, wherein a piece of equipment for a wellhead is positioned from the installation by being lowered into the water at the lower end of a riser-type string comprising a main string connecting the top of the wellhead to the surface installation, and the piece of equipment, in addition, is connected to the installation by auxiliary hoses for servicing and remote control, said method comprising the following successive steps:

connecting said piece of equipment in a removable manner to the lower end of a first section of the main string, supporting from the surface installation and connecting laterally with respect to said piece of equipment, the lower ends of the auxiliary hoses for servicing and remote control, the upper ends of which are held on said installation at a distance from said main string, with the interposition of curvature-limiting elements directed downwardly, in the vicinity of said piece of equipment so that under the action of gravity each of said auxiliary hoses forms a catenary at a distance from said main string between said piece of equipment and the surface installation, gradually lowering said piece of equipment from the surface installation by connecting successive sections of said main string and causing a sufficient length of said auxiliary hoses to advance from the surface installation until the piece of equipment is connected to the top of the wellhead, and adjusting the length of said auxiliary hoses from the surface installation, thus modifying the distance separating said catenaries from the bottom of the water.

2. Apparatus for performing drilling operations and servicing of an underwater well from a surface installation, comprising a piece of equipment for an underwater wellhead, a riser connecting the top of the piece of equipment to the surface installation, said riser comprising a main string, and a plurality of auxiliary hoses for servicing and remote control that connect said piece of equipment to said installation, means for allowing disconnection of said main string from said piece of equipment in a way that is totally independent of said auxiliary hoses and means for suspending said auxiliary hoses from said installation independently of said main string and at a distance from the main string and for making possible the continuous advance of said hoses, the length of which is adjusted in service so that under the effect of gravity the hoses form a plurality of catenaries which surround at a distance, at least partially, said main string and each one of which has a first end supported by the surface installation, the second end of a catenary being connected to said piece of equipment of the wellhead and means for limiting curvature of each of said hoses, connected to and directed downwardly from said piece of equipment.

3. The apparatus according to claim 2, wherein said means for suspending the auxiliary hoses from said installation comprise a plurality of rotatable drums, on which the hoses are to be wound, supported on the surface installation, each of said drums being operatively associated with one of said hoses.

4. An apparatus according to claim 2, wherein the means for limiting the curvature of each of said hoses comprises a plurality of stiffener elements positioned at the ends of the hoses connected to the piece of equipment, said stiffener elements directing the end portions of the hoses downwardly away from the piece of equipment.

* * * * *